United States Patent [19]

Burns

[11] Patent Number: 5,062,272

[45] Date of Patent: Nov. 5, 1991

[54] REFRIGERATOR OR FREEZER FRESHENING DEVICE AND PROCESS

[75] Inventor: Marsha L. Burns, Casa Grande, Ariz.

[73] Assignee: MarShel Corporation, Mesa, Ariz.

[21] Appl. No.: 594,332

[22] Filed: Oct. 9, 1990

[51] Int. Cl.[5] ..... F24F 3/16

[52] U.S. Cl. ..... 62/78; 62/441; 62/531

[58] Field of Search ..... 62/78, 440, 531, 441; 239/51.5, 56, 57, 60

[56] References Cited

U.S. PATENT DOCUMENTS 4,948,567 8/1990 Atarashiya ..... 62/78 X 4,955,208 9/1990 Kawashima et al. ..... 62/78 X

*Primary Examiner*—Lloyd L. King

*Attorney, Agent, or Firm*—Harry M. Weiss

[57] ABSTRACT

A freshener device for air for use in a refrigerator or freezer compartment for replacing an unwanted odor with a food or fruit-like scent. A process therefor is also provided. The device includes a perforated front plate and a perforated rear plate and a peripheral plate enclosing a chamber containing a selected particle mixture of about a 5 percent food or fruit extract, about 47 percent carbon filter type particles and about 48 percent sodium carbonate particles. The rear plate has a support and attachment means for mounting the device on an inner surface of a refrigerator or freezer wall and spaced therefrom.

10 Claims, 1 Drawing Sheet

REFRIGERATOR OR FREEZER FRESHENING DEVICE AND PROCESS

The invention relates to a refrigerator or freezer freshening device and process, and, in particular, the invention relates to a refrigerator or freezer freshener device having a composition which provides either a natural food or fruit type scent thereby overcoming possibly noxious or stale food odors that may be coming from a refrigerator or freezer.

BACKGROUND OF THE INVENTION

A prior art refrigerator freshener device is described in U.S. Pat. No. 2,222,882, issued Nov. 26, 1940. Related patents include U.S. Patent Numbers

| | |
|---|---|
| Des. 270,468, | issued September 6, 1983, |
| 3,747,902, | issued July 24, 1973, |
| 4,306,892, | issued December 22, 1981, |
| 4,327,056, | issued April 27, 1982, |
| 4,419,326, | issued December 6, 1983, |
| 4,452,500, | issued June 5, 1984, |
| 4,708,851, | issued November 24, 1987, and |
| 4,865,816, | issued September 12, 1989. |

The above cited prior art refrigerator freshener unit includes a front plate and a rear plate and a peripheral plate which enclose a chamber that contains a composition which removes an unwanted odor, and a support hook for suspending the unit from a refrigerator shelf.

One problem with the prior art refrigerator freshener unit is that the freshener unit support hook limits the location of placement of the unit. Another problem with the prior art refrigerator freshener unit is that the unit does not fully remove the unwanted odor in the refrigerator.

SUMMARY OF THE INVENTION

According to the present invention, a refrigerator or freezer freshener device is provided. This device comprises a front plate and a rear plate and a peripheral plate which enclose a chamber having at least one of a natural food and fruit scent means for providing a natural food or fruit type scent thereby overcoming possibly noxious or stale food odors that may be coming from a refrigerator or freezer and a support means coupled to the rear plate for attaching the freshener unit to one of the walls of the refrigerator or freezer unit.

By using the support means mounted on the rear plate, limiting of the location of placement of the unit is minimized. In addition, by using a natural food or fruit type scent means, this type of scent replaces an unwanted odor with a natural food or fruit scent thus, the unwanted odor is effectively replaced or removed from the refrigerator or freezer.

The foregoing and other, objects, features and advantages will be apparent from the following description of the preferred embodiment of the invention as illustrated in the accompanying drawings.

DESCRIPTION OF THE PREFERRED EMBODIMENTS

Figure 1:
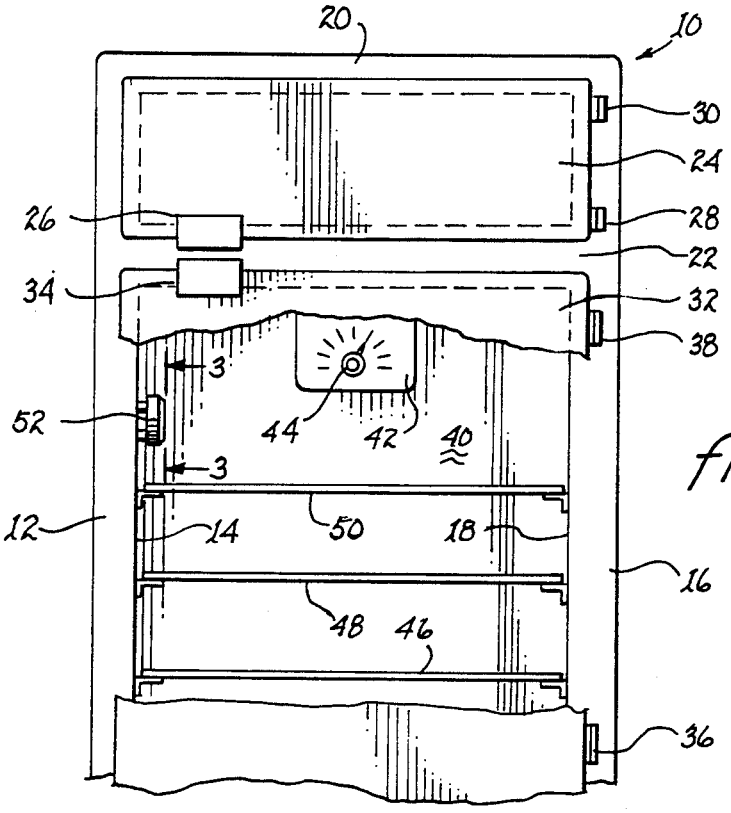
FIG. 1 is an elevation view of a refrigerator or freezer freshener unit according to the present invention.
Figure 2:
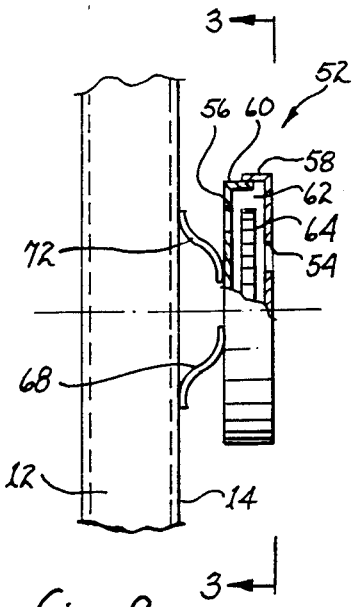
FIG. 2 is an enlarged view of a portion of FIG. 1.
Figure 3:
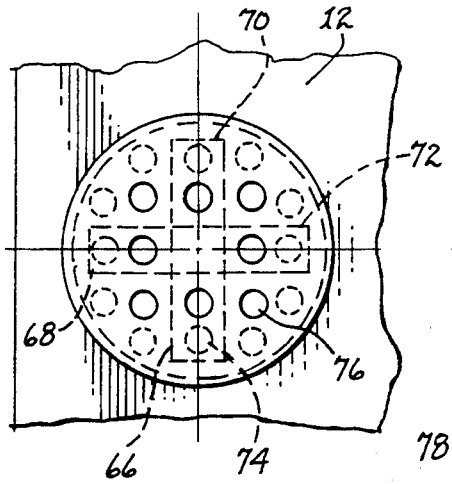
FIG. 3 is a view as taken along line 3—3 of FIG. 2.

As shown in FIGS. 1, 2 and 3, a refrigerator or freezer 10 is provided. Refrigerator or freezer 10 has a left wall 12 which has an inner surface 14; and has a right wall 16 which has an inner surface 18. Refrigerator or freezer 10 also has a top wall 20 and a partition wall 22. Refrigerator or freezer 10 also has a freezer door 24 which has a handle 26 and a pair of hinges 28, 30; and has a second refrigerator (or freezer) door 32 which has a handle 34 and a pair of hinges 36, 38. Walls 12, 16, 20, 22 and doors 24, 32 are preferably made of sheet steel with an insulation filler.

Refrigerator or freezer 10 has a compartment 40, which has a control unit 42 that has a control dial 44. Refrigerator or freezer 10 also has, for example, three shelves 46, 48, 50. Refrigerator or freezer 10 also has a freshener unit 52 which is mounted, for example, on surface 14 of wall 12.

Freshener unit 52 has a relatively thin, preferably sheet steel, front plate 54 (see FIG. 2) and a relatively thin, preferably sheet steel, rear plate 56. Plates 54, 56 have respective overlapping edge portions 58, 60 which form a peripheral plate. Plates 54, 56 enclose a chamber 62. Chamber 62 contains a preferably porous type composition or particle mixture 64 which is preferably suspended in the chamber 62 (by support means, not shown) and is composed of particles of a natural food material such as a vanilla extract, chocolate extract, etc. and/or a natural fruit material such as a strawberry, cherry, lemon, orange, etc. a selective material. Mixture 64 removes an unwanted odor, such as an unwanted food odor, and provides a wanted food or fruit scent, such as a vanilla food scent, a chocolate food scent, or a fruit scent such as cherry, orange, strawberry, etc. Rear plate 56 adheres to preferably four S-shaped, magnetized metal, prongs 66, 68, 70, 72 (see FIG. 3 and FIG. 2), which adhere to or are magnetically coupled to steel wall surface 14. Rear plate 56 also has preferably twelve apertures or vent holes 74. Front plate also has preferably eight apertures or vent holes 76. Holes 74, 76 are smaller than the particles of mixture 64.

Mixture 64 preferably contains by weight a mixture of three materials, i.e., about 5 percent food or fruit extract particles, and about 47 percent carbon type filter particles, and about 48 percent sodium carbonate particles.

Figure 4:
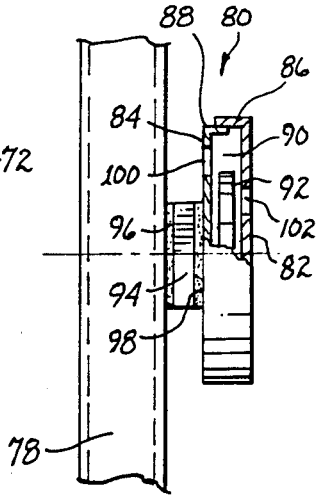
FIG. 4 is an enlarged view of a second embodiment of a refrigerator or freezer freshener unit corresponding to FIG. 2.

As shown in FIG. 4, a second embodiment or refrigerator or freezer freshener unit 80 is mounted on refrigerator or freezer wall 78. Freshener unit 80 has a preferably plastic front plate 82, and a plastic rear plate 84. Plates 82, 84 have respective overlapping edge portions 86, 88 forming a peripheral plate. Plates 82, 84 enclose a chamber 90, which contains a particle mixture 92 that provides a food or fruit type scent or fragrance.

Rear plate 84 has a support disc 94, which has a first adhesive layer 96 that is attached to wall 78, and which also has a second adhesive layer 98 that is attached to rear plate 84. Rear plate 84 also preferably has twelve apertures or vent holes !00. Front plate 82 has preferably eight vent holes 102.

Particle mixture 92 of the FIG. 4 embodiment is similar to particle mixture 64 of the FIG. 2 embodiment.

Process

A process for replacing an unwanted odor in the compartment 40 with a food-like scent is provided. The process includes, mounting freshener unit 52 or 80 on an inner surface 14, placing a particle mixture 64 or 92 in the chamber 62 or 90, and passing air with the unwanted odor through the front plate 54 or 82 and mixture 64 or 92 and rear plate 56 or 84 in either direction.

The advantages of freshener unit 52 and 80 are indicated hereafter.

A. Freshener unit 52 and 80 removes an unwanted odor from a refrigerator or freezer compartment 40.

B. Freshener unit 52 and 80 provides a natural food or fruit type scent in the refrigerator compartment 40.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

1. A freshener unit for a refrigerator or freezer having a plurality of walls with inner surfaces enclosing a compartment comprising:

a front plate having at least one aperture;

a rear plate having at least one aperture;

a peripheral plate joined to the front plate and rear plate;

said plates enclosing a chamber; said chamber having at least one of a natural food and fruit scent means for providing a natural food or fruit smell to overcome possible noxious or stale food odors; and support means coupled to said rear plate for attaching said freshener unit to one of said walls of said refrigerator or freezer and mounted on an inner surface of said wall.

2. The freshener unit of claim 1, wherein said scent means is a particle mixture containing by weight about 5 percent of fragrant food or fruit particles and about 47 percent of carbon filter type particles and about 48 percent of sodium carbonate particles.

3. The freshener unit of claim 2, wherein the fragrant food particles are vanilla extract particles.

4. The freshener unit of claim 2, wherein the fragrant fruit particles are cherry extract particles.

5. The freshener unit of claim 2, wherein the fragrant food particles are particles soaked in a food extract.

6. The freshener unit of claim 1, wherein said support means includes a plurality of magnetized-metal S-shaped prongs; and said rear plate is composed of steel material.

7. The freshener unit of claim 1, wherein said support means includes a support member having a first adhesive layer attached to the refrigerator wall inner surface and having a second adhesive layer attached to the freshener unit rear wall.

8. The freshener unit of claim 7, wherein said front plate and rear plate and peripheral plate are composed of a plastic material.

9. A process for replacing an unwanted odor in a space with a food or fruit-like scent including the step of:

passing a volume of air having an unwanted odor through a composition including about 5 percent food or fruit extract, about 47 percent carbon filter type material and about 48 percent sodium carbonate material.

10. The process of replacing an unwanted odor in a refrigerator or freezer compartment with a fruit extract scent including the steps of:

mounting a freshener unit having a perforated front plate and a perforated rear plate and peripheral plate with a chamber on an inner surface of a wall of the refrigerator or freezer and offset from the inner surface;

placing a particle mixture containing by weight about 5 percent food or fruit extract and about 47 percent carbon filter type particles and about 48 percent sodium carbonate particles in the chamber; and circulating air with the unwanted odor through the front and rear plates and the particle mixture.

* * * * *